US006487931B1

(12) United States Patent
Hara et al.

(10) Patent No.: US 6,487,931 B1
(45) Date of Patent: Dec. 3, 2002

(54) ESCAPEMENT CYLINDER

(75) Inventors: Koji Hara, Ibaraki (JP); Susumu Takada, Ibaraki (JP)

(73) Assignee: SMC Corporation, Tokyo (JP)

( * ) Notice: Subject to any disclaimer, the term of this patent is extended or adjusted under 35 U.S.C. 154(b) by 43 days.

(21) Appl. No.: 09/671,169

(22) Filed: Sep. 28, 2000

(30) Foreign Application Priority Data

Oct. 18, 1999 (JP) ..... 11-295970

(51) Int. Cl.[7] ..... G05G 1/00; F01B 13/04; F01B 3/00

(52) U.S. Cl. ..... 74/579 R; 92/71; 417/269; 91/499

(58) Field of Search ..... 74/579 R, 579 E; 294/88; 318/568.11; 92/12.2, 13.5, 71; 417/269; 91/499

(56) References Cited

U.S. PATENT DOCUMENTS 4,892,344 A * 1/1990 Takada et al. ..... 294/88
5,243,264 A * 9/1993 Takada et al. ..... 318/568.11
5,363,741 A * 11/1994 Takada et al. ..... 92/13.5
5,385,450 A * 1/1995 Kimura et al. ..... 417/269
5,960,697 A * 10/1999 Hayase et al. ..... 92/12.2
6,024,541 A * 2/2000 Perstnev et al. ..... 417/269
6,079,313 A * 6/2000 Wolcott et al. ..... 92/71

FOREIGN PATENT DOCUMENTS

JP 2514783 8/1996
JP 11-82420 3/1999

* cited by examiner

*Primary Examiner*—Vinh T. Luong
(74) *Attorney, Agent, or Firm*—Oblon, Spivak, McClelland, Maier & Neustadt, P.C.

(57) ABSTRACT

When one piston 3A and 3B moves to the forward edge by the pressured fluid supplied to the head side pressured chamber 5A and 5B, two communicating paths 11A and 11B communicates the head side pressured chamber 5A and 5B with the rod side pressured chamber 5B and 5A of other piston 3B and 3A. In a rod holding unit plate, the rod holding unit plate is provided such that one engaging unit 21A and 21B of the rod holding unit plate is in sliding contact with the side surface of this piston rod 4A and 4B to regulate the oscillation during one piston rod 4A and 4B is making forward or is setting back. At the same time, the rod holding unit plate is provided such that other engaging unit 21B and 21A of the rod holding unit plate 21 is engaged in the hollow 25 of other piston rod 4B and 4A located at the forward edge to engage the returning operation of the piston rod.

6 Claims, 2 Drawing Sheets

ESCAPEMENT CYLINDER

TECHNICAL FIELD

The present invention relates to a cylinder for escapement to perform a stable operation.

PRIOR ART

An escapement cylinder, in which two piston rods of two cylinders mounted in parallel on a cylinder body are alternately moved backward and forward by the action of a pressured fluid and other piston rod is brought in backward when one piston rod attains a vicinity of a forwarding edge, has been known conventionally (for example, see Japanese Utility Model Publication No. 2514783). According to this known escapement cylinder, a communication path mounted between both cylinders introduces the pressured fluid used for making a first piston rod forward into a pressured chamber at the side at which the piston rod is made backward in other cylinder when the first piston rod attains the forward edge and the piston rod is brought in backward with that pressured fluid.

According to the escapement cylinder with the above constitution, as described above, it is possible to perform a desired operation such that switching the pressured fluid appropriately in the above communication path makes the other piston rod when one piston rod attains a vicinity of the forwarding edge. However, when one piston rod attains a vicinity of the forward edge, a part of the pressured fluid for making the piston rod forward is introduced in the other cylinder. Therefore, the escapement cylinder with the above constitution involves a problem such that the fluid pressure at the side for making the piston rod forward is lowered temporarily at this time and the thrust of the piston rod is lowered.

Further, during one piston rod is making forward, the fluid pressure is not effected on the piston rod of the other cylinder. Accordingly, when the external force is effected on this piston rod, there is a problem such that the piston rod is moved by this external force.

In order to solve the forgoing problems, for example, Japanese Laid Open Patent Publication No. 11-82420 discloses an escapement cylinder such that other piston rod is brought in locked automatically during one piston rod is moving forward and backward. However, in this well known example, when one piston rod is making forward, the fluid pressure for driving effects on other piston rod which is locked on the forwarding edge in the direction for making the other piston rod backward. Therefore, there is a case that the force effects on the other piston rod in the direction orthogonal to an axial line through a locking mechanism from this locked piston rod to have effect on the operation of the piston rod in forward movement. As a result, a countermeasure is required to solve this problem. Further, it is desired that the above described locking mechanism has a simple constitution and is stably operated.

DISCLOSURE OF THE INVENTION

The present invention has been made taking the foregoing problems into consideration, a technical object of which is to provide an escapement cylinder having a simple constitution and operating stably.

A further concrete technical object of the present invention is to provide an escapement cylinder such that when a piston rod attains a vicinity of the forward edge, the thrust of the piston rod is not lowered temporally by lowering of the fluid pressure and the other piston rod is not moved by the external force during one piston rod is moving.

Another technical object of the present invention is to provide an escapement cylinder such that the force does not effect on the other piston rod in the direction orthogonal to an axial line through a locking mechanism from this locked piston rod differently from the escapement cylinder disclosed in the above described Japanese Laid Open Patent Publication No. 11-82420 when the other piston rod is automatically locked during one piston rod is moving. Accordingly, this escapement cylinder has a locking mechanism, which stably operates with a very simple constitution.

In order to solve the foregoing problems, an escapement cylinder according to the present invention comprises two pistons arranged in parallel within one cylinder body, two piston rods, which are extended in parallel from the two pistons, of which front edges are projected to the outside and which has hollows for locking therein, head side pressured chambers and rod side pressured chambers, which are comparted and formed on opposite sides of the respective pistons, respectively, ports for supplying a pressured fluid separately to the two head side pressured chambers, two communicating paths for communicating the head side pressured chamber of one piston with the rod side pressured chamber of other piston when one piston moves to a forward edge by supply of the pressured fluid to the head side pressured chamber and a rod holding unit plate, which is supported by a pin between the two piston rods oscillatably and has engaging units at portions facing to respective piston rods, respectively, to operate such that one engaging unit is in sliding contact with a side surface of this piston rod and the oscillation of this piston rod is regulated during one piston rod is making forward or is setting back and at the same time, other engaging unit is engaged in a hollow of other piston rod located at the forward edge to regulate the returning operation of the other piston rod.

According to an embodiment of the present invention, the rod holding unit plate is formed by a triangle plate, the engaging units are formed by two vertical angles and the pin is mounted between these vertical angles.

According to another embodiment of the present invention, the respective piston rods comprise a first portion at a base edge along the piston and a second portion at a front edge, which is coupled with the front edge of this first portion and is in sliding contact with the rod holding unit plate. The outer size of this second portion is made larger than the outer size of the first portion, so that the hollow is formed on the coupling portion of these both portions by the difference in size between these two portions.

Said first portion of the respective piston rods forms a column shape and the second portion of the respective piston rods forms a rectangular column shape. It is preferable that engaging a projection in T-shape, which is formed on the front edge of the first portion, in a T-shaped groove, which is formed on the base edge of the second portion, allows these first and second portions to be coupled each other in floating.

The escapement cylinder having above descried constitution operates two piston rods alternately by supplying a pressured fluid and automatically locks other piston rod to a forwarding edge with a rod holding unit plate during one piston rod is making forward or making backward. For example, in the state that a second piston rod is mounted at the forwarding edge and a first piston rod is mounted at a backward edge, supplying the pressured fluid to a pressure chamber at a head side of the first piston allows this first piston rod to make forward. At this time, in the above rod holding unit plate, one holding unit is in sliding contact with the side surface of the first piston rod in moving and the oscillation thereof is regulated. On the other hand, in the above rod holding unit plate, other holding unit is fitted and engaged in a hollow of the second piston rod, which is located at the forwarding edge and the returning operation thereof is limited.

When he foregoing first piston rod attains the forward edge, the head side pressure chamber of this first piston and the rod side pressure chamber of the second piston are communicated each other in the communicating path, so that the pressured fluid is flowed into this rod side pressure chamber and the foregoing second piston rod begins to make backward from the forward edge. At this time, in the forgoing rod holding unit plate, two holding units are fitted into hollows in the first and the second piston rods at the forwarding edge at the same time, respectively, to be capable of being oscillated when the foregoing first piston rod attains the forwarding edge. Therefore, the foregoing second piston rod is unlocked temporarily to be capable of making backward. Then, when this second piston rod starts making backward, in the foregoing rod holding unit plate, one engaging unit is in sliding contact with the side surface of the second piston rod to regulate its oscillation. On the other hand, other engaging unit is engaged in the hollow of the foregoing first piston rod located at the forwarding edge to regulate its returning operation.

In the case that the foregoing second piston rod, which attains the backward edge, the same operation as that of the above described case is performed.

Thus, the piston rod attaining the forward edge is locked there, so that the thrust of the piston rod is not lowered temporally by lowering of the fluid pressure and the other piston rod is not moved by the external force during one piston rod is moving differently from the conventional escaping cylinder.

Further, when one piston rod is locked at the forwarding edge, the fluid pressure does not effect this piston rod unless other piston rod attains the forwarding edge. Therefore, the force is not applied to the side surface of the piston rod in forward movement by pushing the rod holding unit plate with this locked piston rod. Thus, respective piston rods are capable of operating stably despite of a very simple constitution of the locking mechanism.

DETAILED DESCRIPTION

Figure 1:
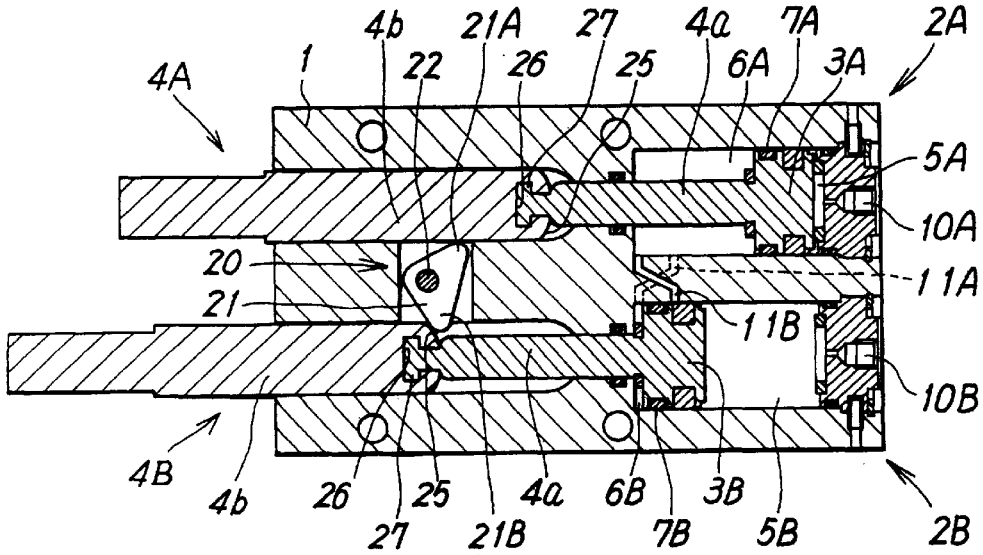
FIG. 1 is a front view showing a preferable example of an escapement cylinder according to the present invention.

FIG. 1 shows an example of an escapement cylinder according to the present invention. This escapement cylinder comprises two cylinders, i.e., a first cylinder 2A and a second cylinder 2B, which are arranged in parallel within one cylinder body 1. These cylinders 2A and 2B, respectively, have pistons 3A and 3B oscillating the inside of cylinder holes, piston rods 4A and 4B extending in parallel from these pistons 3A and 3B to protrude to the outside of cylinder body 1, respectively and head side pressure chambers 5A and 5B and rod side pressure chambers 6A and 6B formed on opposite sides of the above respective pistons 3A and 3B, respectively. The foregoing piston rods 4A and 4B make forward and backward alternately by supplying the pressured fluid to the above head side pressure chambers 5A and 5B. For example, as shown in FIG. 1, when the second piston rod 4B is located at the forward edge, other first piston rod 4A makes backward. On the contrary, when the first piston rod 4A starts to make forward from the backward edge shown in FIG. 1 and attains the forward edge or the vicinity of the forward edge, the second piston rod 4B located at the forward edge makes backward.

Both of cylinders 2A and 2B in the above escapement cylinder have ports 10A and 10B for supplying the pressured fluid from the outside to respective head side pressure cambers 5A and 5B individual. On the other hand, the foregoing cylinder body 1 is provided with two communicating paths 11A and 11B for communicating one of the head side pressure chambers 5A and 5B of one of the pistons 3A and 3B and one of the rod side pressure chambers 6A and 6B of the other one of pistons 3B and 3A each other when one of the pistons 3A and 3B moves to the forwarding edge.

In these communicating paths 11A and 11B, first hole edges thereof open to the vicinity of the forwarding edges of unilateral cylinder holes and second hole edges at the opposite side open to the lather backward separately from the forwarding edges of other cylinder holes. As indicated by the second piston 3B in FIG. 1, these second hole edges and the foregoing pistons 3A and 3B are related so that piston packings 7A and 7B climb over the foregoing second holes edges when respective pistons 3A and 3B start to make forward and attain approximately the forward edge. Thus, the piston packings 7A and 7B climb over the second hole edges of the communicating paths 11A and 11B, so that one of the head side pressure chambers 5A and 5B of one of the pistons 3A and 3B and one of the rod side pressure chambers 6B and 6A of the other one of the pistons 3B and 3A communicate each other. Further, the pressured fluid of the foregoing head side pressure chambers 5A and 5B is introduced in the rod side pressure chambers 6B and 6A, which communicate with the head side pressure chambers 5A and 5B and the piston rods 4B and 4A start to perform returning operation.

A locking mechanism 20 is arranged between the foregoing cylinders 2A and 2B to automatically engage other piston rods 4B and 4A at the forward edges during respective piston rods 4A and 4B are moving forward or backward. This locking mechanism 20 comprises a rod holding unit plate 21 in a triangle plate and this rod holding unit plate 21 is supported oscillatably with a pin 22 mounted on a central portion between the two piston rods 4A and 4B in the above cylinder body 1. Two vertical angles of this rod holding unit plate 21 comprise engaging units 21A and 21B and each of the engaging units 21A and 21B face to one of two piston rods 4A and 4B. Further, while one of the piston rods 4A and 4B is moving forward or backward, one of the engaging units 21A and 21B facing to one of piston rods 4A and 4B is in sliding contact with the side surface of one of piston rods 4A and 4B to regulate the oscillation of the rod holding unit plate 21. At the same time, other one of engaging units 21B and 21A is engaged in a hollow 25 in other one of piston rods 4B and 4A at the forwarding edge to engage the returning operation thereof.

Each of the forgoing piston rods 4A and 4B comprise a first portion 4*a* at the base end or edge b side along each of the piston rods 3A and 3B and a second portion 4*b* at the front edge f, with which the front edge of this first portion 4*a* is coupled and the above rod holding unit plate 21 is in sliding contact. Further, making larger the outer size of this second portion 4B in an axial direction than the outer size of the first portion 4*a,* the above hollows are defined with the difference in size at the coupling portions of these both portions 4*a* and 4*b*.

Figure 3:
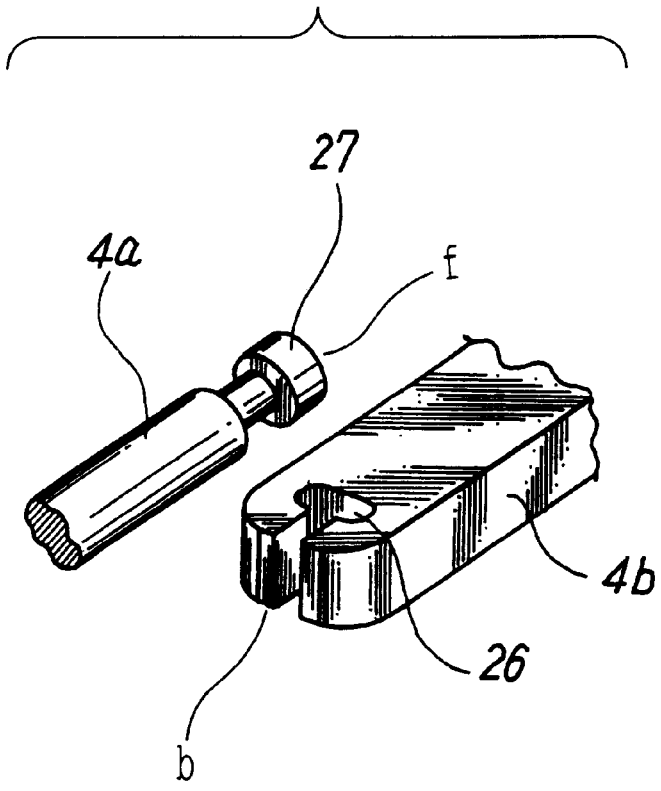
FIG. 3 is a partial enlarged perspective view showing a piston rod constitution in the exploded state.

The first portion 4*a* and the second portion 4*b* are separately formed and the first portion 4*a* has a circle section and the second portion 4*b* has a rectangular section. These first portion 4*a* and the second portion 4*b* are coupled in floating by coupling a projection 27 in T-shape, which is formed at the front edge of the first portion 4*a* in a groove 26 in T-shape, which is formed at the base edge of the second portion 4*b,* as shown in FIG. 3. Thus, it is possible to turn up the cores of the above first portion 4*a* and the second portion 4*b* easily and it is possible to form the foregoing the hollow 25 easily. However, these first portion 4*a* and the second portion 4*b* may be formed integrally.

The piston rods 4A and 4B in the two cylinders 2A and 2B supply the pressured fluid such as the compressed air or the like from the ports 10A and 10B to the head side pressured chambers 5A and 5B, so that the escapement cylinder constituted as above makes forward and backward alternately. At this time, while one of the piston rod 4A or 4B is moving forward or backward, other one of piston rod 4B or 4A is automatically locked to the forwarding location.

In other words, as shown in FIG. 1, when the second piston 3B and the second piston rod 4B are located at the forwarding edges and the first piston 3A and the first piston rod 4A are located at the backward edges, the pressured fluid such as compressed air or the like is supplied to the head side pressured chamber 5A of the above first piston 3A. As a result, these first piston 3A and the first piston rod 4A make forward. At this time, in the rod holding unit plate 21, one engaging unit 21A is in sliding contact with the side surface of the second portion 4*b* in the first piston rod 4A, which is making forward, and the oscillation is regulated. Other engaging unit 21B is fitted into the hollow 25 of the above second piston rod 4B at the forwarding edge and is engaged to the backward edge of the second portion 4*b,* so that the second piston rod 4B is engaged at the forwarding edge.

When the foregoing first piston 3A and the first piston rod 4A attain the forward edge and the piston packing 7A climbs over the opening of the communicating path 11A, the head side pressured chamber 5A of this first piston 3A and the rod side pressured chamber 6B of the second piston 3B communicate each other in the foregoing communicating path 11A. Therefore, the pressured fluid is flowed into this rod side pressured chamber 6B and the foregoing second piston 3B and the second piston rod 4B start to set back from the forward edge. At this time, when the foregoing first piston rod 4A attains the forward edge, the foregoing rod holding unit plate 21 is capable of being oscillated by fitting simultaneously the two engaging units 21A and 21B within the hollows 25 of the first and the second piston rods 4A and 4B, which are located at the forward edges, respectively. Accordingly, the forgoing second piston rod 4B is temporarily unlocked to be capable of set backing. Further, if this second piston rod 4B starts to set back, one engaging unit 21B is in sliding contact with the side surface of this second piston rod 4B, so that the oscillation of the foregoing rod holding unit plate 21 is regulated. Other engaging unit 21A is engaged in the hollow 25 of the foregoing first piston rod 4A at the forward edge to lock this first piston rod 4A at the forward edge.

In the case of forward movement of the foregoing second piston rod 4B, which attains the backward edge, the operation, which is identical with the above described operation, is carried out.

Thus, since the piston rod attains the forward edge to be locked to the forward edge, the thrust of the piston rod is not lowered temporarily due to lowering of the fluid pressure differently from the conventional escapement cylinder. Further, during one piston rod of the cylinder is moving, other piston rod of other cylinder does not move by the external force.

If one piston rod is locked to the forward edge, the fluid pressure does not effect this piston rod unless other piston rod attains the forward edge. Therefore, the rod holding unit plate is not pushed by this locked piston rod, so that the force does not effect on the side surface of the piston rod in forward movement. As a result, respective piston rods are capable of being stably operated despite of a very simple constitution of the locking mechanism.

Figure 2:
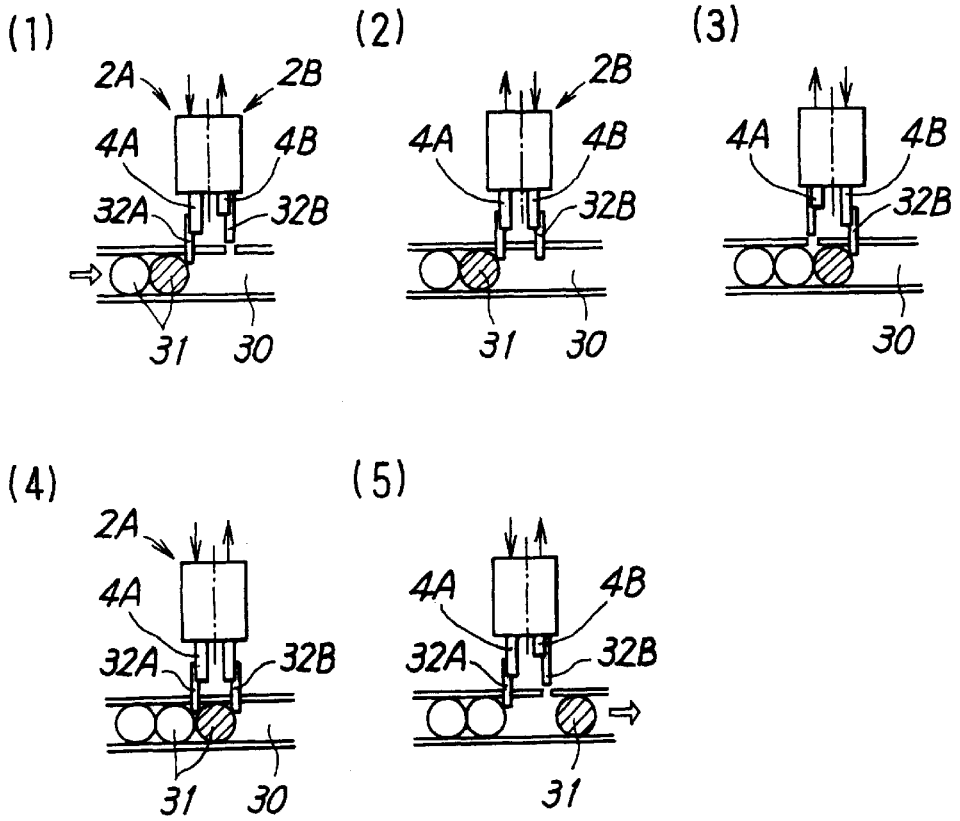
FIGS. 2(1) to 2(5) are front views showing the state that the escapement cylinder shown in FIG. 1 is used.

FIGS. 2(1) to (5) show an example that the foregoing escapement cylinder is used for controlling the operation of a work 31 to be sent along a transporting path 30 one by one.

FIG. 2(1) shows a state that the piston rod 4A of the first cylinder 2A makes forward, so that a stopper 32A disposed on the front edge of the piston rod 4A is projected within the transporting path 30 to stop the flowing of the work 31. FIG. 2(2) shows a state that the second piston rod 4B makes forward by supply of the compressed air to the second cylinder 2B in order to change a stopping position of the work 31, so that a stopper 32B disposed on the front edge of the piston rod 4B is projected within the transporting path 30. FIG. 2 (3) shows a state that the first piston rod 4A sets back according to the forward movement of the foregoing second piston rod 4B.

FIG. 2(4) shows a state that supply of the compressed air to the pressured chamber of the first cylinder 2A makes the piston rod 4A forward and the stopper 32A disposed on the front edge of the piston rod 4A is projected within the transporting path 30 to restrain the flowing of the following work 31. FIG. 2 (5) shows a state that the second piston rod 4B sets back according to the forward movement of the foregoing first piston rod 4A and the work 31 held between the stoppers 32A and 32B is sent out.

The example for using the escapement cylinder shown in FIGS. 2(1) to (5) is merely an example and the above described escapement cylinder may be used for various applications.

According to the present invention described above in detail, the escapement cylinder for performing a stable operation with a simple constitution can be obtained. Particularly, when one piston rod attains the forward edge, the thrust of the piston rod is not lowered temporally by lowering of the fluid pressure and the other piston rod is not moved by the external force during one piston rod is moving differently from the conventional example.

Further, during one piston rod is making forward or is setting back, when other piston rod is automatically locked by the locking mechanism, the force by the pressured fluid does not effect other piston rod via the locking mechanism from one piston rod in the direction orthogonal to the axial line of the other piston rod. Therefore, there is no bad effect on the operation of the piston rod.

Accordingly, it is possible to operate the locking mechanism stably with a very simple constitution. Particularly, the rod holding unit plate constituting the locking mechanism with a triangle plate supported by the pin allows the locking mechanism to operate stably with a very simple constitution.

Further, since the piston rod and its enlarged diameter portion are formed with separate members to couple the piston rod and its enlarged sectorial portion in floating, it is possible to turn up the cores of the piston rod and its enlarged sectorial portion. At the same time, portions for engaging the rectangular angle portions of the holding unit plate in the enlarged sectorial portion edge is capable of being easily formed.

What is claimed is:

1. An escapement cylinder comprising:

two pistons, i.e., a first and a second pistons arranged in parallel within a cylinder body;

two piston rods, i.e., a first and a second piston rods, which are extended in parallel from the two pistons, of which front edges are projected to the outside of the cylinder body and which has hollows for locking therein;

head side pressured chambers and rod side pressured chambers, which are comparted and formed on opposite sides of the respective pistons, respectively;

ports for supplying a pressured fluid separately to the two head side pressured chambers;

two communicating paths for communicating the head side pressured chamber of one piston with the rod side pressured chamber of other piston when one piston moves to a forward edge by supply of the pressured fluid to the head side pressured chamber; and a rod holding unit plate, which is supported by a pin between the two piston rods oscillatably and has engaging units at portions facing to respective piston rods, respectively, to operate such that one engaging unit is in sliding contact with a side surface of at least one piston rod and the oscillation of the at least one piston rod is regulated during one piston rod is making forward or is setting back and at the same time, other engaging unit is engaged in a hollow of other piston rod located at the forward edge to regulate the returning operation of the other piston rod.

2. An escapement cylinder according to claim 1, wherein the rod holding unit plate is formed by a triangle plate, the engaging units are formed by two vertical angles and the pin is mounted between these vertical angles.

3. An escapement cylinder according to claim 2, wherein the respective piston rods comprise a first portion at a base edge along the piston and a second portion at a front edge, which is coupled with the front edge of this first portion and is in sliding contact with the rod holding unit plate; the outer size of this second portion is made larger than the outer size of the first portion, so that the hollow is formed on the coupling portion of these both portions by the difference in size between these two portions.

4. An escapement cylinder according to claim 3, wherein the first portion of the respective piston rods forms a column shape and the second portion of the respective piston rods forms a rectangular column shape; a projection in T-shape, which is formed on the front edge of the first portion, is engaged in a T-shaped groove, which is formed on the base edge of the second portion, so that these first and second portions are coupled each other in floating.

5. An escapement cylinder according to claim 1, wherein the respective piston rods comprise a first portion at a base edge along the piston and a second portion at a front edge, which is coupled with the front edge of this first portion and is in sliding contact with the rod holding unit plate; the outer size of this second portion is made larger than the outer size of the first portion, so that the hollow is formed on the coupling portion of these both portions by the difference in size between these two portions.

6. An escapement cylinder according to claim 5, wherein the first portion of the respective piston rods forms a column shape and the second portion of the respective piston rods forms a rectangular column shape; a projection in T-shape, which is formed on the front edge of the first portion, is engaged in a T-shaped groove, which is formed on the base edge of the second portion, so that these first and second portions are coupled each other in floating.

* * * * *